US008043041B1

(12) United States Patent
Neeley et al.

(10) Patent No.: US 8,043,041 B1
(45) Date of Patent: Oct. 25, 2011

(54) MANHOLE COVER LIFTING APPARATUS AND METHOD

(76) Inventors: Alvin L. Neeley, Puyallup, WA (US); Steven M. Davis, Federal Way, WA (US)

( * ) Notice: Subject to any disclaimer, the term of this patent is extended or adjusted under 35 U.S.C. 154(b) by 2671 days.

(21) Appl. No.: 09/440,149

(22) Filed: Nov. 15, 1999

Related U.S. Application Data

(63) Continuation of application No. 09/233,417, filed on Jan. 19, 1999, now abandoned, which is a continuation of application No. 08/625,698, filed on Apr. 3, 1996, now abandoned, which is a continuation of application No. 08/489,360, filed on Jun. 12, 1995, now abandoned.

(51) Int. Cl.
*B66C 11/12* (2006.01)

(52) U.S. Cl. ..... 414/684.3; 212/166; 254/133 R

(58) Field of Classification Search ..... 414/684.3, 414/495; 294/15, 17; 254/131, 133 R, 4 R, 254/7 R, 100; 280/63, 79.11; 212/166, 226
See application file for complete search history.

(56) References Cited

U.S. PATENT DOCUMENTS

| | | | | | |
|---|---|---|---|---|---|
| 1,083,182 | A | * | 12/1913 | Bean | 254/133 X |
| 1,890,765 | A | | 12/1932 | Zent | |
| 3,885,688 | A | * | 5/1975 | Larsen | 254/131 X |
| 4,181,290 | A | | 1/1980 | Affolter | |
| 4,321,003 | A | | 3/1982 | Castle | |
| 4,365,925 | A | | 12/1982 | Gritz | |
| 4,488,706 | A | | 12/1984 | Kono | |
| 4,653,728 | A | | 3/1987 | Mochizuki et al. | |
| 4,662,526 | A | * | 5/1987 | Schaller | 212/166 |
| 4,662,607 | A | | 5/1987 | Mochizuki et al. | |
| 4,746,098 | A | | 5/1988 | Abarotin | |
| 5,035,336 | A | * | 7/1991 | Schmitz et al. | 212/166 |
| 5,674,045 | A | * | 10/1997 | Eckloff et al. | 414/684.3 |

FOREIGN PATENT DOCUMENTS

| | | | | |
|---|---|---|---|---|
| GB | 2045206 A | * | 10/1980 | 212/166 |
| GB | 2111017 | * | 6/1983 | |

* cited by examiner

*Primary Examiner* — Donald Underwood
(74) *Attorney, Agent, or Firm* — Robert B. Hughes; Hughes Law Firm, PLLC

(57) ABSTRACT

A manhole lifting apparatus comprising a base support assembly and a lifting mechanism. There is a beam structure which extends over the manhole, with a pivot support at one end of the beam structure, and a mobile support at the opposite end of the beam structure. The lifting mechanism is at the central part of the beam structure. The lifting mechanism lifts the manhole cover, and the support assembly is rotated about the pivot support to remove the manhole cover from the manhole.

1 Claim, 7 Drawing Sheets

134
132
130
140
124
128
126

138
136
142
130
94
120
84
118b
80
106

78
70
74
76
72
58
68
82
80
60
20
50
80

MANHOLE COVER LIFTING APPARATUS AND METHOD

RELATED APPLICATIONS

This Patent Application is a continuation of U.S. Ser. No. 09/233,417 filed Jan. 19, 1999 (now abandoned), which is a continuation of U.S. Ser. No. 08/625,698 filed Apr. 3, 1996 (now abandoned), which is a continuation of Ser. No. 08/489,360 filed Jun. 12, 1995 (now abandoned).

BACKGROUND OF THE INVENTION a) Field of the Invention

The present invention relates to an apparatus and method for lifting and removing larger and heavier objects which are at least moderately awkward to handle, and more particularly to such an apparatus and method for lifting and removing manhole covers from a manhole frame, and accomplishing this in a manner to facilitate the process to avoid injury to workers.

b) Background Art

Manholes are commonly located at streets and other surface locations to provide access to some underground location, and these are commonly used in connection with utilities (power or communication lines, sewers, etc.). When a workman travels to a site where some operation has to be for the utility, sewer, or other need, there is generally the preliminary task of removing the manhole cover, from the surface opening, and then replacing it.

There are various ways of accomplishing this, sometimes a crowbar-like tool is used to lift one edge of the manhole cover, after which a lever-like tool is used to lift it first vertically so that it is clear of the surrounding frame and then laterally.

The task of replacing the manhole cover is accomplished in somewhat the same manner.

Statistically, the task of removing and replacing manhole covers has been found to be a high risk operation in terms of promoting and or causing back and other muscular-skeletal injuries. In spite of this, to the best knowledge of the applicant herein, there has not as yet been devised a method and/or apparatus for removing manhole covers which has gained wide commercial acceptance, where the apparatus and/or method is effective and convenient, while providing little or substantially no risk of injury to the workers.

A search of the patent literature has disclosed a number of U.S. patents that deal with the problem of lifting manhole covers and the like, these are the following:

U.S. Pat. No. 4,181,290 (Affolter) shows a device for lifting a manhole cover or other vault cover. There is a base comprising three legs extending outwardly from a center location. There is an upright post, and a lifting arm is connected to the center base portion of the three legs and also is connected to the post. This arm is raised to lift the cover.

U.S. Pat. No. 4,488,706 (Kono) shows a manhole cover lifting device where there is a lever bar having a hook on the lifting end, and a rearwardly positioned handle. The bar is supported by a pair of wheels at the lifting location. The hook end of the bar is secured to the cover, and the opposite end of the bar is pushed downwardly to lift the manhole cover, as the bar pivots on the wheels which serve as a faucrum.

U.S. Pat. No. 4,365,925 (Gritz) shows a manhole cover lifter which is similar to the above mentioned Kona patent. There is a bar 11 that is supported by a set of wheels. One end of the bar is secured to the cover, and the other has a handle which is pressed downwardly to lift the manhole cover as the bar pivots on the wheels which serve as a faucrum.

U.S. Pat. No. 4,321,003 (Cassel) shows what is called a "lifting tool" and shows an arrangement in which a pair of anti-friction bearings, as shown in sheet 4 of the drawings of the patent, are secured to a elongate lift rod that clamps at each end to the vault cover. A handle is lifted to rotate the rod which is connected to the inner races of the bearings. These are rotated 180° so that the cover is raised high enough to be rolled on the outer races of the bearings.

U.S. Pat. No. 4,746,098 (Abarotin) shows a manhole cover lifting device in which there is a bar that extends from a ground supported pivot 17 to a handle at the other end. There is a means to attach the cover to the bar aligned on the center of the bar. In use the bar is secured to the cover and the handle end is lifted. The parts are pivoted on the member 17 so that the cover is swung out of the way.

U.S. Pat. No. 4,653,728 (Mochizuki) shows a manhole cover lifter where there is a pair of wheels, each of which is fastened adjacent to a grasping means. There are series of lever associated with the wheel mounts that enable the lifting and maneuvering of the lid.

U.S. Pat. No. 4,662,607 (Mochizuki et al) shows a lifting device where there is an elongate bar mounted to ground wheels at a location near the manhole the bar is used as a lever, with the wheels acting as a fulcrum to lift the manhole cover by the front portion of the bar.

U.S. Pat. No. 1,890,765 (Zent) shows an amusement park ride which in FIG. 17 is shown as a car with wheels mounted at angles to each other.

SUMMARY OF THE INVENTION

The lifting assembly of the present invention is arranged to lift an object which has a width dimension and it at least partially surrounded by a base surface which has a substantial horizontal alignment component. In the preferred embodiment, this object is a manhole cover (also called a vault cover) surrounded by a paved or ground surface. This lifting assembly is particularly adapted to enable the object (or manhole cover) to be lifted in a manner which substantially eliminates, or at least substantially alleviates, potential injury to a workman who is to remove the manhole cover.

The assembly comprises a base support assembly which in turn comprises a beam structure which has a lengthwise axis, is adapted to be positioned above the object, and has a lengthwise dimension greater than the width dimension of the object. The beam structure has a first pivot end and second mobile end.

The base support assembly also comprises a pivot support connected to the beam structure and located at the pivot end thereof. The pivot support is arranged to support the pivot end of the beam structure from the base surface.

The base support assembly also comprises a mobile support connected to the beam structure and located at the mobile end thereof. This mobile support is arranged to support the mobile end of the beam structure form the base surface. The mobile support has mobile base surface engaging means to enable the mobile support to be moved laterally over the base surface.

There is a lifting mechanism mounted to the base support assembly and comprises a lift connection to engage the object and an actuating means to lift the object.

Thus, the lift assembly can be positioned over the object with the pivot support being on one side of the object and the mobile support being on an opposite side of the object, so that the lifting mechanism is able to raise the object. The lifting assembly can then be moved laterally so as to move the object.

In the preferred form, the pivot support is arranged to engage the base surface in a manner to remain at a substantially stationary base surface location during movement of the lifting assembly. More particularly, the surface engaging means of the mobile support is arranged to move in an arcuate path having the stationary location of the pivot support being at a center of said arcuate path.

In a preferred embodiment, the surface engaging means comprises a pair of base surface engaging wheels positioned on opposite sides of the mobile end of the beam structure. Each of the wheels has an axis of rotation, with the two axes of rotation converging and meeting at substantially said location of the pivot support.

In the preferred form, the pivot support comprises a post extending downwardly from the pivot end of the beam structure, with a lower end of the post being adapted to engage the base surface.

In a preferred embodiment, the lifting mechanism comprises a lifting jack mounted to the beam structure at an intermediate location between the pivot end and the mobile end of the beam structure. In the preferred form, the jack has a substantially vertical lift axis, and the jack has a lifting member connected to a lower end thereof to said lift connection. The jack has actuating means to raise the lifting member relative to the beam structure. In a specific embodiment, the jack is a screw jack, comprising an actuating screw vertically align in the jack, and further comprising manually operable crank means to turn the actuating screw.

A preferred form of the lift connection comprises a pair collet fingers adapted to be positioned in a lift opening of the object. There is means to expand the collet fingers outwardly to come into gripping engagement with the surface of the lift openings.

Also, there is provided an auxiliary lift bar which has an auxiliary lift connection to lift the object at an off-center connecting location spaced from a center of gravity of said object. The lift bar has a lifting mechanism connecting portion adapted to be located near a center of gravity of the object and be connected to the lifting mechanism near the center of gravity. The auxiliary bar has a torque portion spaced from said center of gravity location, the torque portion has a torque member engaging said object at a location spaced from the off center connecting location to apply a torque from the auxiliary arm to said object so that said object is lifted entirely from said base surface. Desirably, the lifting mechanism connecting portion has adjustable connecting means whereby said auxiliary lift bar is able to engage said object at various locations spaced from the center of gravity.

In the method of the present invention the beam structure is positioned over the object which is then lifted, as described above. The lifting assembly is moved laterally.

Other features will be apparent from the following detailed description.

DESCRIPTION OF THE PREFERRED EMBODIMENT

Figure 1:
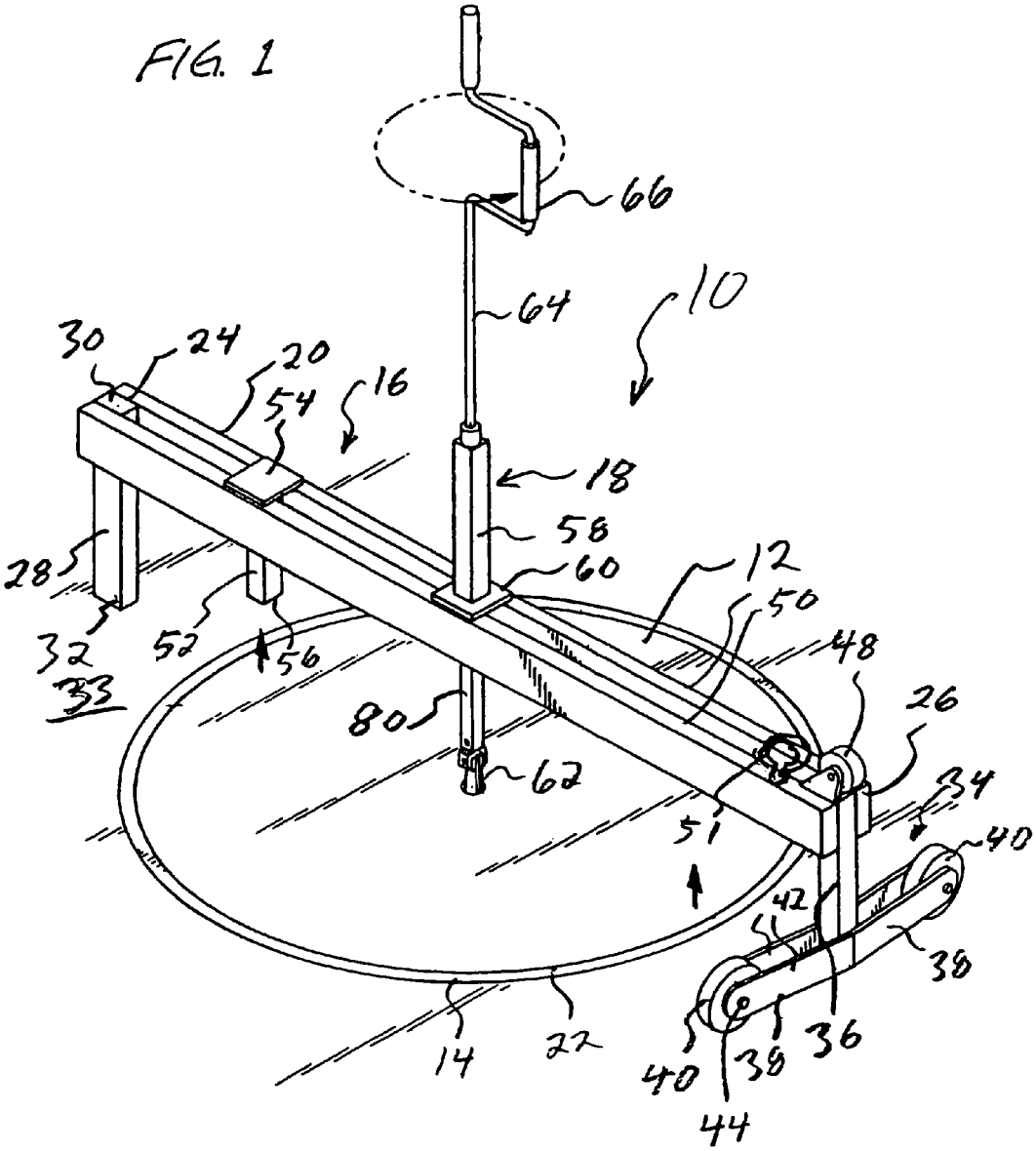
FIG. 1 is an isometric view illustrating the apparatus of the present invention in its operating position.

The apparatus 10 of the present invention is shown in FIG. 1 in its operating position to lift a manhole cover 12 out of its surrounding support frame 14. More recently a "manhole cover" is often referred to as a "vault cover" or a "utility vault cover". It is to be understood that the term "manhole cover" also refers to these. This apparatus 10 comprises two main components, namely a lift support base assembly 16 and a lifting mechanism 18.

The base assembly 16 comprises three main components. First, there is a main lifting bar 20 which in the operating position of FIG. 1 extends entirely across the manhole cover 12 so that both ends of the bar 20 extend beyond the perimeter 22 of the manhole cover 12. This bar 20 has a pivot end 24 and a mobile end 26. This bar functions as a beam structure and could also be configured as a truss or other support member to transfer lifting loads from a central location out to the end locations.

The second component of the base assembly 10 is a pivot support provided as a post 28 having an upper end 30 fixedly connected to the lift bar 20 and extending downwardly to its lower pavement engaging end 32. (Since a manhole is generally positioned at a paved location, such as in a street, it will be assumed that the surface surrounding the manhole frame 14 is the paved surface 33.) The pivot support could in some instances be structured so as to be able to move laterally over the ground surface but functions in most instances quite reliably by having ground engagement at a single ground location where it is able to pivot at that location. One advantage of this is that it is easier for one man to remove the cover by himself. Also, with a stationary pivot location, when the manhole cover is replaced, the pivot post 28 keeps the position of the cover 12 constant relative to the arcuate path it travels to make it much easier to align the cover 12 with the perimeter frame 14, thus facilitating replacement.

The third main component is a mobile support member 34 which comprises a support post 36 and a pair of arms 38 extending generally oppositely from one another from the lower end of the post 36. Each arm 38 has at its end a related ground engaging wheel 40.

Figure 3A:
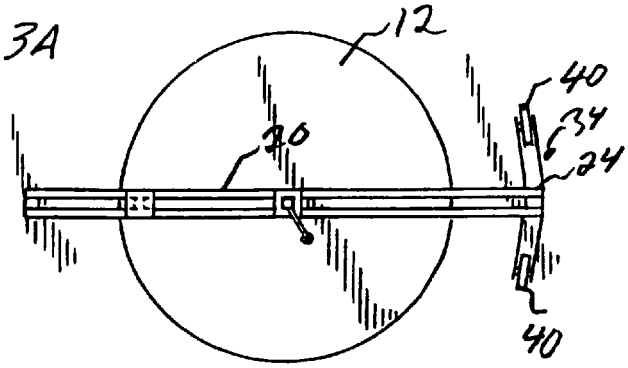
FIG. 3A is a top plan view showing the apparatus in its position above a manhole cover to lift the manhole cover vertically.
Figure 3B:
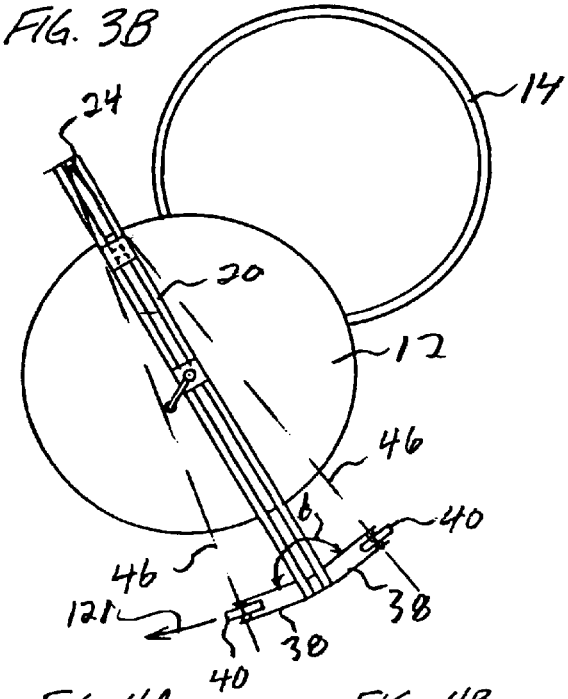
FIG. 3B is a top plan view similar to FIG. 3A, but showing the manhole cover having been moved to a side location away from the manhole.

Each of the arms 38 comprises a pair of elongate arm plates 42 which are spaced apart from one another a short distance so that the wheel 40 can be mounted between the outer end portions of its related pair of arm plates 42, so that the wheel 40 can freely rotate about its axle 44. With reference to FIGS. 3A and 3B, it can be seen that the two pair of arms 38 (made up of arm plates 42) are not diametrically opposed at a 180° angle. Rather, these two arms 38 are angled with respect to one another so that the interior angle formed by these two arms 38 (i.e. the interior angle being that angle facing the pivot location 24 indicated at "b" in FIG. 3B) is slightly less than 180°. This angle is selected so that the two axes of rotation 46 of the wheels 40 converge and meet at the end pivot location 24. Thus, it can be seen that these wheels 40 are aligned so that as the apparatus 10 is rotated about the pivot location 24, these wheels 40 follow an arcuate path having the pivot location 24 as its center of the arcuate path of travel.

Figure 15:
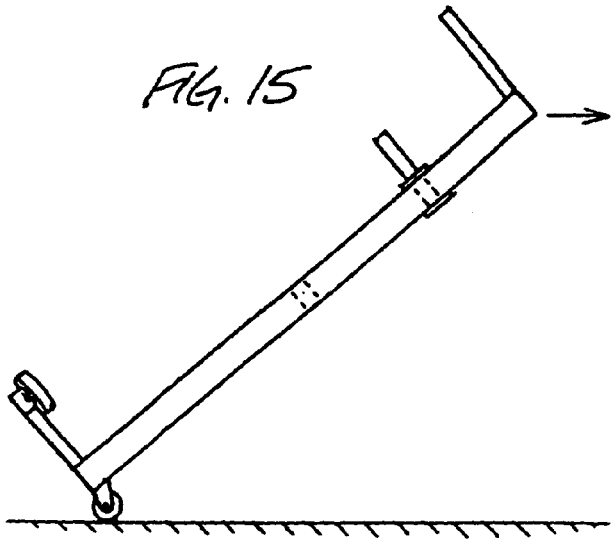
FIG. 15 shows the apparatus of the present invention being positioned so that it can be rolled along a street or ground surface.

It will be noted that at the top of the post 36 at the mobile end 26 of the lifting bar 20 there is mounted a rotatable wheel 48 having its axis of rotation perpendicular to the length of the bar 20. Thus, as can be see in FIG. 15, the apparatus 10 can be positioned to rest on the wheel 48 so that the apparatus 10 can easily be moved along the paved surface 33, with the wheel 48 providing ground support. Also an eyebolt 51 is connected to the mobile end 26 of the bar 20, so that this could be engaged to pull the mobile end laterally (see FIG. 3B).

The bar 20 is conveniently made as two elongate plate members 50 spaced laterally from one another. The ends of the two elongate plates 50 are fixedly connected at one end to the post 28 and at the other end to the post 36 so that a substantially rigid bar 20 is formed. Also, at a location between the pivot post 28 and the lifting mechanism 18, there is provided a stabilizing post 52 which is fixedly mounted to the bar 20 by means of a mounting plate 54. This stabilizing post 52 has a lower end 56 positioned a short distance above the plane defined by the lower end 32 of the pivot post 28 and the lower surfaces of the pavement engaging wheels 40. the function of this stabilizing post 52 is to help position the manhole cover 12 as it is being lifted, and this will be described in more detail later herein.

The aforementioned lifting mechanism 18 is shown in this preferred embodiment as a screw jack or screw actuator. This lifting mechanism 18 comprises an elongate square housing 58 which is fixedly mounted by means of a plate 60 to the bar 50 at a mid-location along the bar 20 so that in the use position, as shown in FIG. 1, the lifting mechanism 18 is centered on the manhole cover 12. At the lower end of the lifting mechanism 18 there is a lift attachment 62. Extending upwardly from the elongate housing 58 there is an actuating rod 64 formed at its upper end with an actuating crank 66. By rotating the crank 66, the lift attachment 62 can be raised or lowered.

Figure 14:
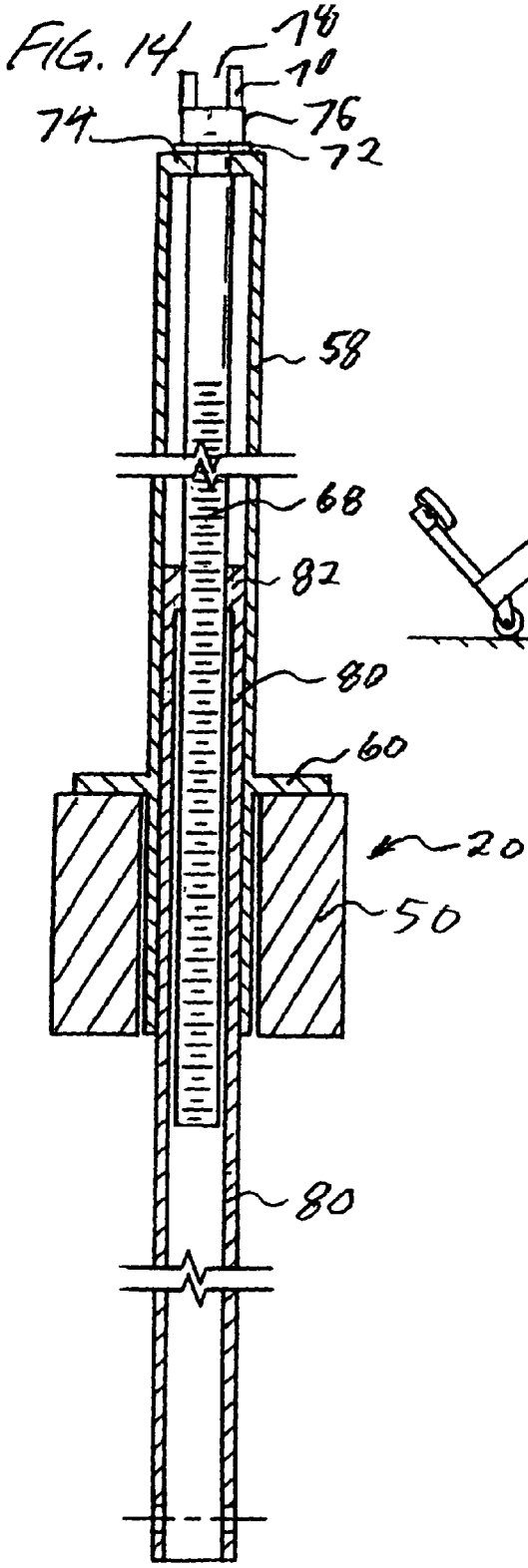
FIG. 14 is a longitudinal sectional view showing the screw jack that is used in the embodiment shown in FIG. 1 to raise the manhole cover.

The internal structure showing the screw drive of the lifting mechanism 18 is illustrated in FIG. 14. There is a threaded actuating screw or drive member 68 which is fixedly attached at its upper end to a drive nut 70 that is mounted by a thrust bearing collar 72 at an upper end plate 74 of the elongate housing 58. This nut 70 attaches through a connecting portion 76 to an upper end of the drive screw 68. The rod 64 has at its lower end a flat sided head portion to engage the upper Allen's head opening 78 of the nut 70.

Positioned within the elongate housing 58 is an interior lifting member 80 having a square configuration and fitting snugly within what in cross section is the square shaped confines of the interior of the housing 58. This member 80 has an upper end portion 82 having a circular threaded opening that engages the threads of the actuating screw 68. Thus, rotation of the drive screw 68 in one direction or the other causing the lifting member 80 to be either raised or lowered.

Figure 5:
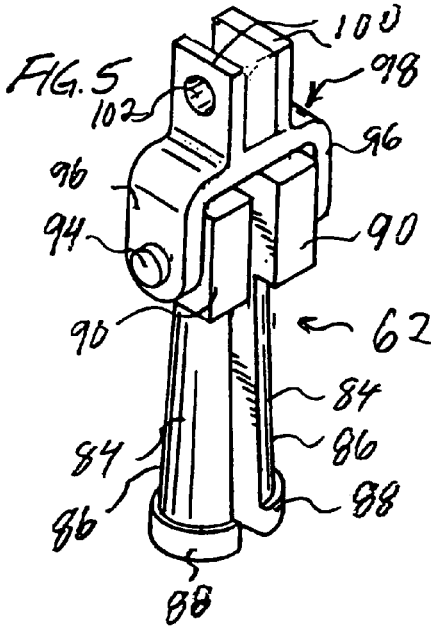
FIG. 5 is an isometric view illustrating a first embodiment of a lifting attachment used to engage the manhole cover.

The structure and functioning of the aforementioned connecting attachment 62 will now be described with reference to FIGS. 5 through 7. This connecting member 62 comprises two collet like fingers 84, each of which has in cross-section a nearly semi-circular configuration so as to have an outer curved surface 86. Each member 84 has a semi-circular expanded lip portion 88 at the bottom portion. The upper ends of the fingers 84 are fixedly connected to (or formed integrally with) respective mounting members 90 which have interior openings 92 to receive a connecting pin 94. The connecting pin in turn connects to lower ears 96 of another connecting member 98. The member 98 has upper ears 100 with openings 102 to receive a connecting pin 104. The pin 104 connects to an intermediate loop-like link 106 that in turn connects by one of its loops to a pin 108 of an upper connector 110. The connector 110 fits within the lower open end of the lifting member 80 and has aligned through openings that match with openings in the member 80 so that a retaining pin 112 can be placed through the openings of the member 80 and the retaining member 110 to retain the connecting attachments 62 in place. The pin 112 has a retaining detente 114 at one end and at the there end a ring 116 by which it can be more easily removed and put back into place.

Figure 6:
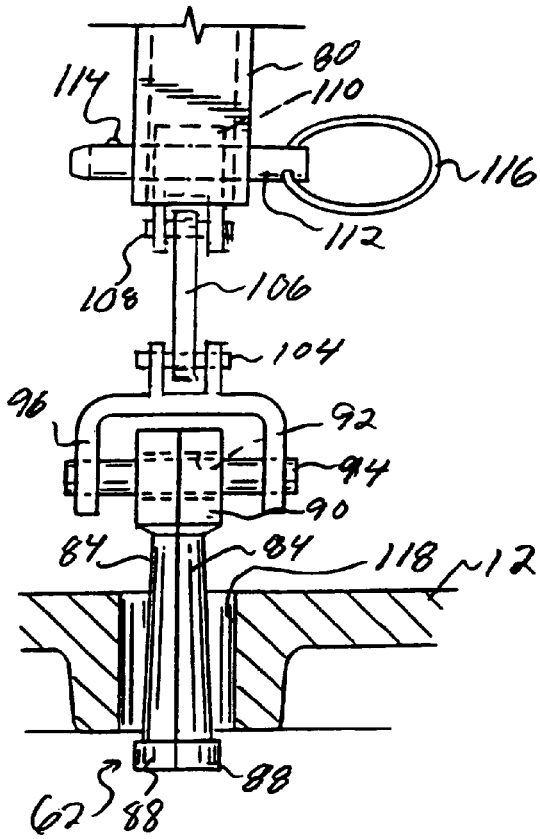
FIG. 6 is a side elevational view showing the manhole cover in section, with the lifting attachment being positioned within the lift access opening of the manhole cover.
Figure 7:
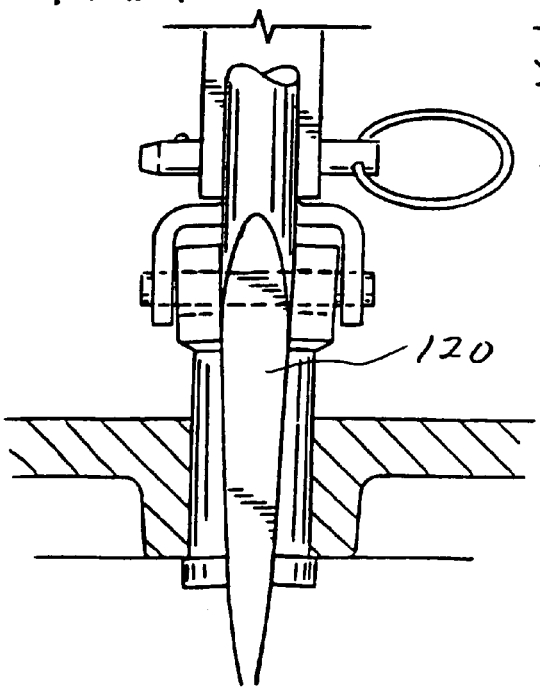
FIG. 7 is a view similar to FIG. 6, showing an expansion wedge inserted into the lifting attachment of FIG. 6 to engage the manhole cover.

To describe the operation of this connecting attachment 62, it is first attached to the lifting member 80 as shown in FIG. 6. With the apparatus 10 being at the position shown in FIG. 1, the jack crank handle 66 is rotated to lower the connecting attachment 62 into the lift access opening 118 of the manhole cover 12. With the connecting attachment 62 positioned as shown in FIG. 6, the bar 20 is moved a short distance laterally so that the upper part of the collet fingers 84 are accessible from immediately above the fingers 84. Then a positioning wedge 120 (see FIG. 7) is pushed between the collet fingers 84 so as to spread these apart and into tight gripping engagement with the surface of the manhole cover opening 118.

To describe the overall operation of the present invention, the apparatus 10 is assembled and put in its operating position as shown in FIG. 1. The crank handle 66 is rotated to lower the lifting member 80 downwardly so that the fingers 84 of connecting attachment 62 moves into manhole cover opening 118. (For ease of illustration, the entire linkage of the connecting attachment 62 is not shown in FIG. 1.) The collet fingers 84 of the connecting attachment 62 are spread apart as shown in FIG. 7 so that these collet fingers 84 are in firm engagement with the sidewall of the opening of the manhole cover opening 118 and outwardly projecting lips 88 is firmly engaged with the underside of the vault cover.

Figure 2A:
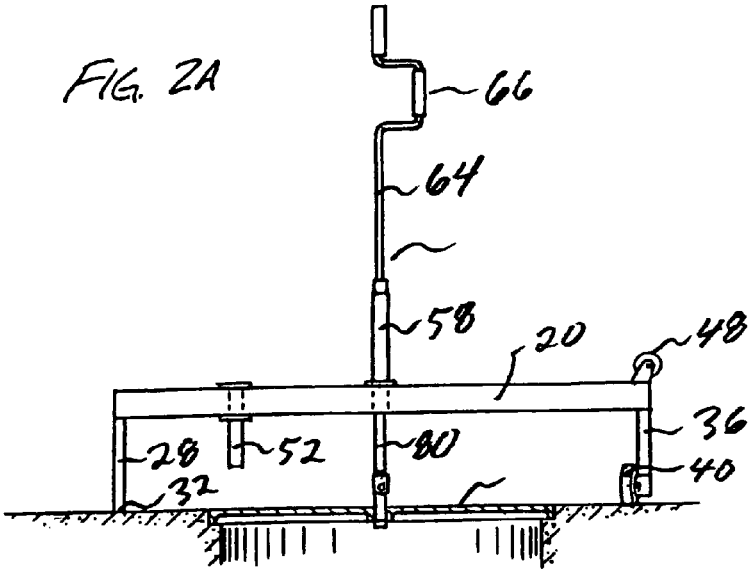
FIGS. 2A through 2C are side elevational views of the apparatus of the present invention operating to lift a manhole cover out of its perimeter mounting frame.
Figure 2B:
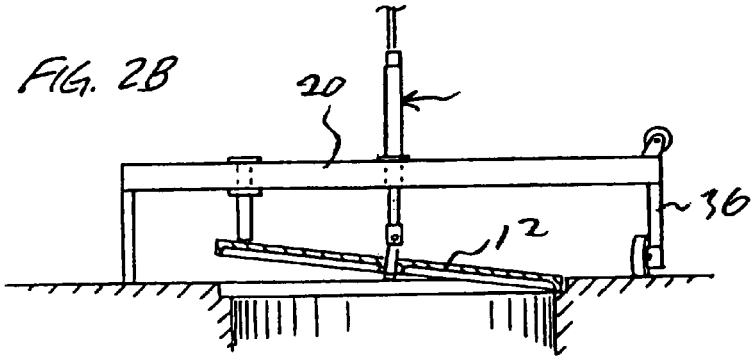
Figure 2C:
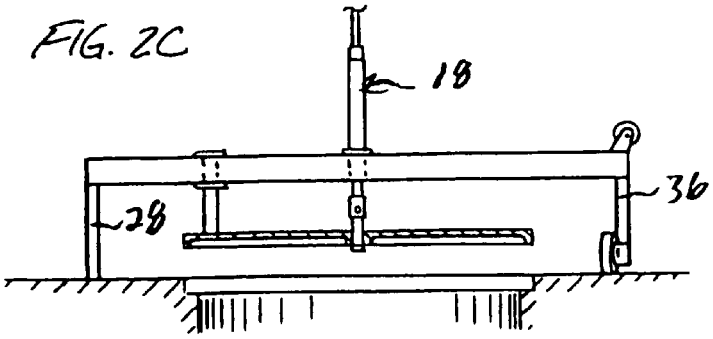

In the position of FIG. 1, the pivot post 28 and the post 36 of the mobile section 34 are on opposite sides of the manhole cover 12 and diametrically opposite one another relative to the circle defined by the manhole cover 12. The crank handle 66 is rotated in a direction to raise the lifting member 80 and thus lift the manhole cover 12 free of its support frame 14. If the manhole cover 12 is formed symmetrically, and if the manhole cover opening 18 is centrally located, then the manhole cover 12 will be lifted without much tilting. In the event the manhole cover 12 is weighted more to one side than the other so that there is some tilting, as can be seen in FIGS. 2A, 2B, and 2C, the apparatus can be positioned so that the positioning post 52 is located at the part of the cover 12 that tends to be tilted upwardly. Thus, when the lifting member 80 continues to be raised, the cover 12 will be raised in a near level position, as shown in FIG. 2C.

Reference is now made to FIGS. 3A and 3B. In FIG. 3A, the cover 12 is shown having been lifted free of the manhole perimeter frame 14. Then the mobile end portion 26 of the apparatus 10 is pulled laterally as indicated by the arrow 121 in FIG. 3B. To avoid any unwanted downward bending motion of the person operating the apparatus 12, it is a simple matter for the workman to take a T-bar hook, and move the hook to engage an eye-bolt 51 and pull the mobile end 26 of the bar 20 laterally and then pull the mobile end of the bar 20 laterally while the workman is in a more upright position.

When the manhole cover 12 has been moved away from over the manhole, the crank 66 can be rotated in the direction to lower the manhole cover so that it rests on the adjacent pavement 32, or it can remain suspended. In that instance, the wheels 40 may be blocked with a small wedge-like member to avoid unwanted movement.

In reviewing the overall operation of the present invention, it can be seen that the entire operation can be accomplished with the workman himself applying substantially no vertical forces. There is little lifting force is required, except possibly to maneuver the apparatus 10 into place. Also, there is no requirement to exert any significant downward force, as is the case in a number of prior art devices which are designed to raise manhole covers. The only force which would be required is to use the arm to rotate the crank 66, and also to pull the mobile end 26 of the apparatus laterally. A review of the human dynamics involved in the entire operation of the apparatus 10 reveals that most (if not all) of the motions and apply forces exerted by the human body which more likely result in a back injury (or other serious injuries) are, if not totally eliminated, at least substantially alleviated.

Figure 4A:
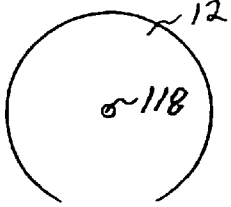
FIGS. 4A, 4B and 4C are top plan views showing different locations or patterns on the manhole cover for a access lifting opening or openings.
Figure 4B:
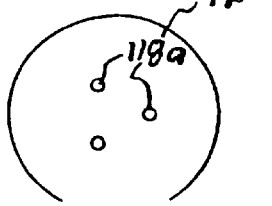

To discuss some of the other features of the present invention. In FIG. 4A there is shown the manhole cover 12 where there is a centrally located access lift opening 118. In FIG. 4B, there is shown a manhole cover 12*a* having three openings 118*a* arranged in a triangular pattern, with the triangle being centered in the cover 12*a*. In 4C, there is a cover 12*b* having a single access lift opening 118*b* which is off center and closer to the edge.

With the arrangement of FIG. 4B, the cover 12*a* could be lifted as shown in FIG. 2B with the use of the positioning member 52. However, the manhole cover 12*b* is more difficult.

Figure 4C:
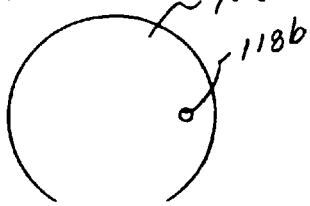
Figures 8, 9:
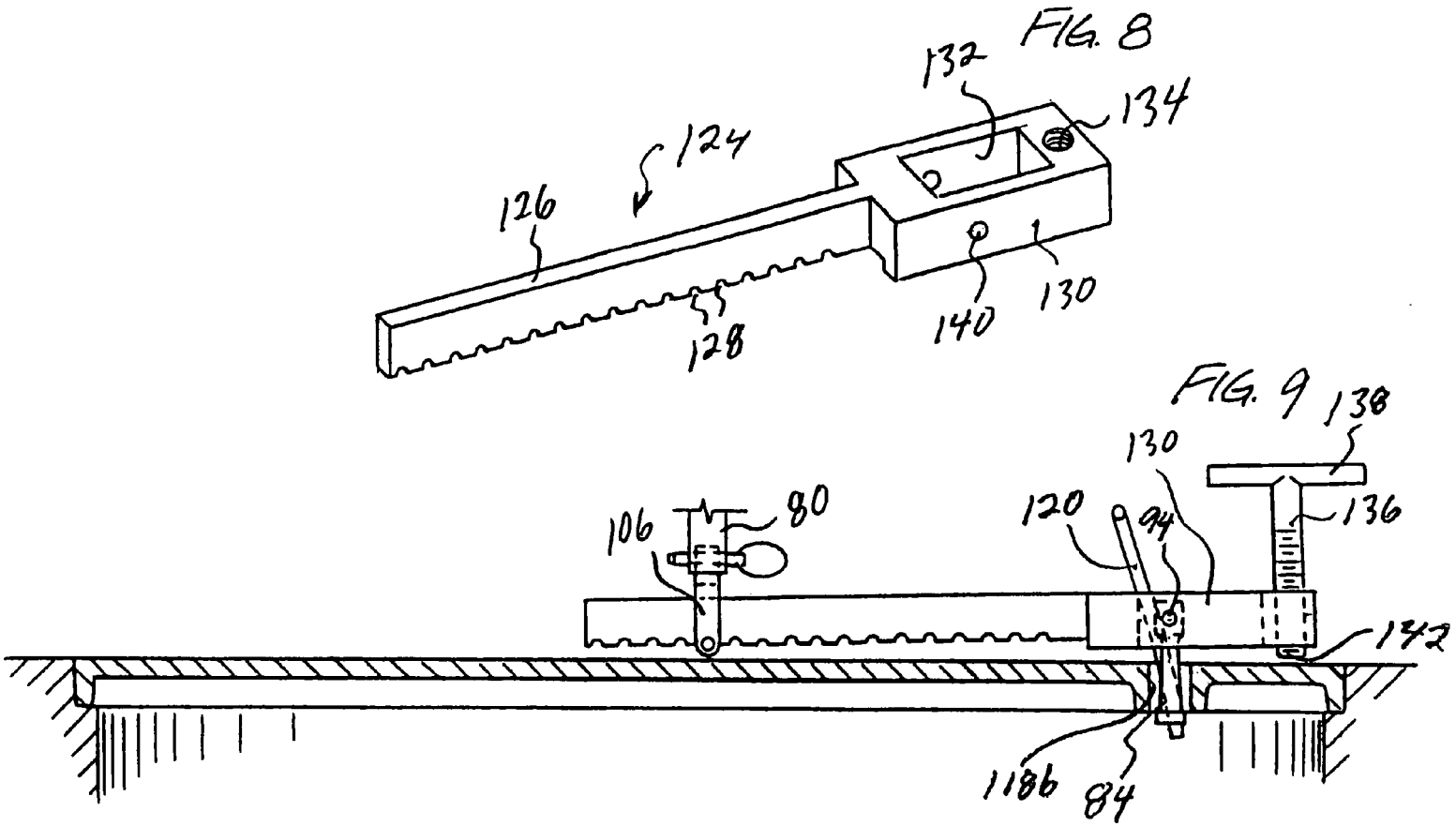
FIG. 8 is an isometric view of an auxiliary lift bar of the present invention.
FIG. 9 is a side elevational view, showing the manhole cover in section, with the auxiliary lift bar being positioned to lift the manhole cover which has an extreme off-center lift access opening.

In order to lift the manhole 12*b* (shown in FIG. 4C) so that it would remain substantially horizontal there is additionally provided, as shown in FIGS. 8 and 9, an auxiliary lift bar 124. This bar 124 has an elongate mounting arm 126 having a plurality of spaced notches 128 along its lower edge. This arm 126 is connected to a link, such as shown at 106, that is in turn connected to the lifting member 80. The arm 126 is in turn rigidly connected to (or formed integrally with) what can be functionally described as a torquing member 130 which has a rectangular configuration and a middle opening 132. At the outside end of the torquing member, there is a threaded through opening 134 to receive a threaded positioning rod 136 having a turning handle 138. Instead of forming threads in the opening 134, a threaded nut can be welded at the opening 134 to position the rod 136. Also, the torquing section 130 has a pair of aligned through openings 140 to receive a pin, such as shown at 94, to mount the two collet fingers 84. The wedging member 120 can thus be inserted through the central opening 132 to spread the collet fingers 84 apart and come into secure engagement with the manhole cover opening 118*b*, or one of the openings 118*a*.

To explain the operation of this auxiliary arm 124, let us assume that the apparatus 10 is in place (as illustrated in FIG. 1,) and that the lifting member 80 of the lift mechanism 18 is in the position shown in FIG. 9. As this lift member 80 is raised, the collet fingers 84 will lift the manhole cover 12*b* at the location of the collet fingers 84. As the cover 12*b* is raised a short distance, it will come into engagement with its lower end 142 of the member 136. Further raising of the lifting member 80 will thus raise the entire cover 12*b* which would remain substantially horizontal.

The reason for this is that the lifting force from the member 80 is applied at a central location in the manhole cover 12*b*. Because the lever arm between the location of the collet fingers 84 and the member 136 is rather short, in comparison with the distance from the collet fingers 84 to the center of the manhole cover, substantial vertical forces will be exerted by the collet fingers 84 and the rod 136. These in turn would cause a moment to be applied against the manhole cover 12*b* to raise the entire manhole cover as the lifting member 80 is raised.

Figure 10:
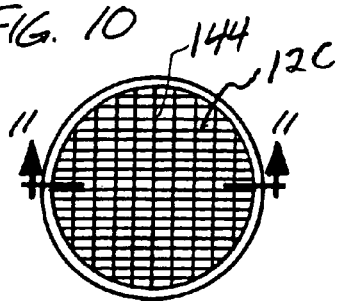
FIG. 10 is a top plan view of a manhole cover having a vented or grated surface with a plurality of openings over the entire surface.
Figure 11:
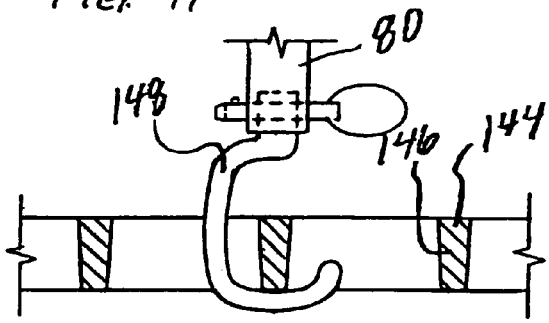
FIG. 11 shows a lift hook used for the manhole cover of FIG. 10.
Figure 13:
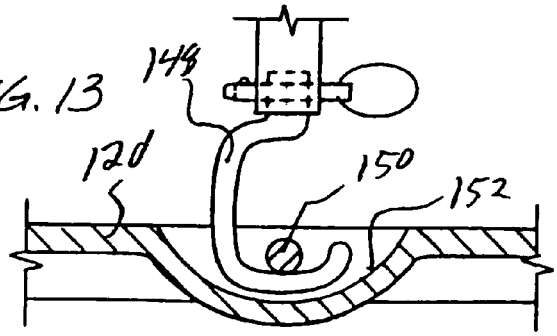
FIG. 13 is a side elevational view showing a lift hook member engaging the finger as shown in FIG. 12.

FIGS. 10 and 11 show another type of manhole cover 12*c* where there is a grid-like cover 144 made up of a plurality of bars 146. In this instance, the lifting member 80 is simply provided with a hook member 148 to accomplish the lifting operation.

Figure 12:
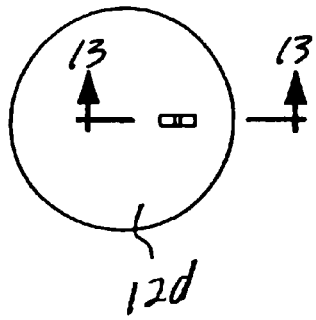
FIG. 12 illustrates a manhole cover having a cross-finger in a recess which provides for lifting engagement.

FIG. 12 shows another type of manhole cover 12*d* where there is a cross finger 150 positioned in a recess 152 formed in the manhole cover 12*d*. The aforementioned hook 148 is connected to the lifting member 80 to lift this cover 12D. It is to be understood that the auxiliary lifting bar 124 (see FIGS. 8 and 9) could be used to accomplish this lifting motion, by connecting the hook member 148 to the pin 94 in the manner shown in FIG. 9.

It is to be recognized that various modifications could be made from the present invention without departing from the basic teachings thereof.

What is claimed is:

1. A lifting assembly arranged to lift an object which has a width dimension and is at least partially surrounded by a base surface which has a substantial horizontal alignment component, such as a manhole cover surrounded by a paved or ground surface, said assembly comprising:

a) a base support assembly comprising:

i. a beam structure which has a lengthwise axis, is adapted to be positioned above the object, and has a length dimension greater than the width dimension of the object, said beam structure having a first pivot end and a second mobile end;

ii. a pivot support connected to the beam structure and located at the pivot end thereof, and arranged to support the pivot end of the beam structure from the base surface;

iii. a mobile support connected to the beam structure and located at the mobile end thereof, and arranged to support the mobile end of the beam structure from the base surface, said mobile support having mobile support having mobile base surface engaging means to enable the mobile support to be moved laterally over the base surface;

b) a lifting mechanism mounted to the base support assembly and comprising a lift connection to engage said object and an actuating means to lift said object, said lift connection comprising a pair of collet fingers adapted to be positioned in a lift opening of said object, and expander to expand collet fingers outwardly to come into gripping engagement with the surface of said lift opening, whereby said lifting assembly can be positioned over said object with the pivot support being on one side of said object and the mobile support being on an opposite side of said object, so that said lifting mechanism is able to raise said object, and said lifting assembly can be moved laterally so as to move said object.

* * * * *